United States Patent [19]

Sluyterman et al.

[11] Patent Number: 4,988,926

[45] Date of Patent: Jan. 29, 1991

[54] COLOR CATHODE RAY TUBE SYSTEM WITH REDUCED SPOT GROWTH

[75] Inventors: Albertus A. S. Sluyterman; Marinus L. A. Vrinten, both of Eindhoven, Netherlands

[73] Assignee: U.S. Philips Corporation, New York, N.Y.

[21] Appl. No.: 465,691

[22] Filed: Jan. 16, 1990

[30] Foreign Application Priority Data

Feb. 8, 1989 [NL] Netherlands ..... 8900306
Oct. 12, 1989 [NL] Netherlands ..... 8902529

[51] Int. Cl.[5] ..... H01J 29/70; H01J 29/76
[52] U.S. Cl. ..... 315/368
[58] Field of Search ..... 315/368; 313/412

[56] References Cited

U.S. PATENT DOCUMENTS 4,642,527 2/1987 Takahashi et al. ..... 313/412
4,725,763 2/1988 Okuyama et al. ..... 313/412
4,864,195 9/1989 Masterton ..... 315/371

*Primary Examiner*—Theodore M. Blum
*Attorney, Agent, or Firm*—Robert J. Kraus

[57] ABSTRACT

A color cathode ray tube system comprising three coplanar electron guns and one deflection unit. A dynamically controlled element driving the outer electron beams away from each other is arranged at the input side of the deflection unit. The underconvergence induced thereby is compensated in that the deflection unit generates deflection fields which cause an overconvergence of the outer beams. This leads to a reduction of the spot growth upon deflection.

9 Claims, 4 Drawing Sheets

COLOR CATHODE RAY TUBE SYSTEM WITH REDUCED SPOT GROWTH

BACKGROUND OF THE INVENTION

The invention relates to a color cathode ray tube system comprising (a) an evacuated envelope having a neck, a cone and a display window, (b) an electron gun in the neck, which gun has a beam-forming part for generating a central electron beam and two outer electron beams whose axes are co-planar, and a first and a second electrode system which in operation jointly constitute a main lens and are connectable to means for supplying an energizing voltage, (c) an astigmatic element in the electron gun for astigmatically influencing the electron beams, and (d) a deflection unit for generating line and field deflection fields for deflecting the electron beams.

Conventional color cathode ray tubes comprise self-convergent deflection units which in operation generate horizontal and vertical magnetic deflection fields in such a way that the three electron beams generated by the electron gun and focused on the display screen by the main lens converge throughout the display window. However, as a result, the electron beams are vertically overfocused on the display window. This can be partly compensated by means of a static astigmatic element in the gun. This is sometimes not sufficient for applications ;n which increasingly stricter requirements are imposed on the definition, for example, for high-resolution color picture display tubes. EP-A-0,231,964 describes a construction for an electron gun (a so-called DAF gun) which enables, by Dynamically coupling the strength of the Astigmatic element to the strength of the deflection fields a substantially complete correction of the vertical overfocusinq.

However, the horizontal spot growth also increases by a given spot enlargement factor in the case of deflection, which actor may be more than two in 110° color cathode ray tube systems. The spot remains in focus or substantially in focus in the horizontal direction throughout the display screen. In the known construction this horizontal spot enlargement factor is not reduced or only reduced to a small extent. Due to the increasingly stricter requirements imposed on the definition of the image, notably in high-resolution color cathode ray tubes or when using color cathode ray tubes for high-definition television, it is also important to reduce the horizontal spot enlargement factor.

SUMMARY OF THE INVENTION

It is one of the objects of the invention to provide a color cathode ray tube of the type described in the opening paragraph in which the horizontal spot enlargement factor upon deflection is reduced. To this end a color cathode ray tube according to the invention is characterized in that an element causing underconvergence is arranged between the beam-forming part of the electron gun and the deflection unit, which element exerts a force on each outer electron beam having a component in the plane of the electron beams transversely to the axis of the relevant outer electron beam and remote from the central electron beam, and in that the deflection unit is constructed in such a way that it generates deflection fields causing an overconvergence which compensates the said underconvergence.

The invention is based on the following recognition: in the element causing underconvergence the outer electron beams undergo, in operation, a force which deflects these electron beams away from the central electron beam. As compared with a conventional self-convergent deflection system, the deflection system is changed in such a way that the color cathode ray tube system as a whole is still "self-convergent". This means that the requirement of self-convergence for the deflection unit has been abandoned so that, in effect, it causes overconvergence of the electron beams on the display window. The change of the deflection unit implies that at least the magnetic line deflection field has a less pronounced astigmatic character. This means that the field has a weak six-pole field component, or even no six-pole field component at all. When reducing the astigmatic character of the deflection fields, the outer electron beams are deflected further towards the central electron beam by the deflection fields. The two effects introduced by the invention on the convergence of the electron beams compensate each other. The object of the invention is achieved in that the less pronounced astigmatic character of at least the line deflection field results in a reduction of the horizontal spot enlargement factor.

The invention is based on a dual recognition.

Firstly, the spot growth is reduced as the location where the electron beams are driven apart is further remote from the screen. For this reason at least the self-convergent line deflection coil is replaced by a line deflection coil which introduces a certain extent of overconvergence of the outer beams and the beams on the gun side of the coil are driven apart. In practice a 45° magnetic 4-pole field is very suitable for this purpose. The current for driving this 4-pole may advantageously have a parabola function at the frequency of the line deflection coil Secondly, dipole deflection fields in any practical gun can be less well-focused than the current self-convergent fields, at least when using a "DAF" gun. The proposed solution presents the advantages of a dipole deflection field with respect to the reduction of the horizontal spot enlargement factor without the drawback of a less satisfactory focusing possibility. This is realised in that the element causing underconvergence ensures that there is a field at the location of the (outer) electron beams whose power in a plane transversely to the electron beams changes gradually, similarly as in the field of a self-convergent deflection unit. The focusing possibility is satisfactory due to this gradual field transition (which is particularly realised by means of a 4-pole field). The focusing possibility is worse in the case of a step-wise field gradient between the beams.

As described hereinbefore, at least the line deflection coil is constructed in such a way that, when energised, it produces a dipole field having a six-pole fie)d component which is too weak for self-convergence, or even having no six-pole field component at all. The produced dipole field may comprise higher harmonic field components (for example 10-pole component, 14-pole component) for reducing y convergence errors (These are errors of, for example, the $yx^3$ or yx type). However, a deflection coil which is adapted to produce such a deflection field generally requires an electric circuit for correcting north-south raster errors.

To reduce Y convergence errors, the cathode ray tube system according to the invention may alternative)y be provided with means which are coaxial with the tube axis and are adapted to generate a 90° magnetic 4-pole field. The deflection coil may then be designed in such a way that no electric circuit for correcting north-south raster errors is necessary. The advantage of this design is that small electric signals may suffice for controlling the means of the 90° magnetic 4-pole field, which signals may be derived from, for example, the field deflection current. This is in analogy with the means for generating a 45° magnetic 4-pole field which means can be controlled by small electric signals which can be derived from, for example, the line deflection current. In contrast to this, strong dynamic signals are required for controlling a north-south raster correction circuit, which complicates the correction.

The means for generating the 90° magnetic 4-pole field are arranged between the beam-forming part of the electron gun and the deflection unit.

A preferred embodiment is characterized in that the above-mentioned means are arranged in the same axial position as the element causing underconvergence, c.q. the means for generating a 45° magnetic 4-pole field. This may be realised, for example, in that the two means comprise coils (four each) which are arranged on one and the same annular core. This annular core can be suitably positioned proximate to the focusing lens of the electron gun.

BRIEF DESCRIPTION OF THE DRAWINGS

These and other aspects of the invention will now be described in greater detail by way of example with reference to the accompanying drawing figures in which.

DESCRIPTION OF THE PREFERRED EMBODIMENTS

Figure 1:
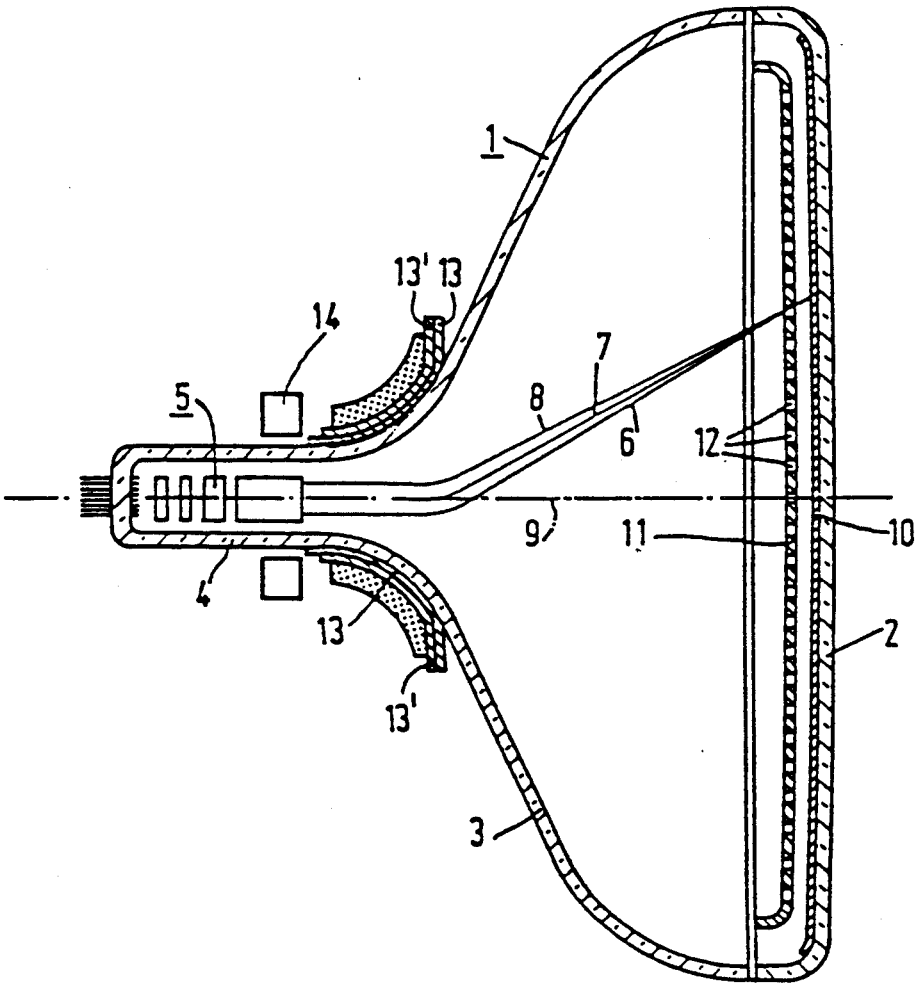
FIG. 1 is a longitudinal section of a color cathode ray tube system according to the invention, including an element 14 causing underconvergence.

FIG. 1 is a cross-section of a color cathode ray tube system according to the invention. A glass envelope 1, which is composed of a display window 2, a cone 3 and a neck 4, accommodates an electron gun 5 in this neck, which gun generates three electron beams 6, 7 and 8 whose axes are located in the plane of the drawing. In the non-deflected state, the axis of the central electron beam 7 coincides with the tube axis 9. The display window 2 has large number of triplets of phosphor elements on its inner side. The elements may consist of, for example, rows or dots. The relevant embodiment shows row-shaped elements. Each triplet comprises a row of a green luminescing phosphor, a row of a blue luminescing phosphor and a row of a red luminescing phosphor. The phosphor rows are perpendicular to the plane of the drawing. A shadow mask 11 is arranged in front of the display screen, which mask has a large number of elongate apertures 12 through which the electron beams 6, 7 and 8 pass and each impinge upon phosphor rows of one color only. The three co-planar electron beams are deflected by the system 13 of deflection coils (for line deflection), and 13′ (for field deflection).

An important aspect of the invention is the use of a 4-pole field for convergence correction of a coil which is not self-convergent in such a way that there is less spot growth than in a fully self-convergent coil. This 4-pole field is generated by means of element 14 (see also FIG. 2).

In the embodiment shown the element 14 comprises an annular core 15 of a magnetizable material on which four coils 16, 17, 18 and 19 are wound in such a way that a 4-pole field having the orientation shown with respect to the three beams 20, 21 and 22 is generated. A 4-pole field may be alternatively generated by means of two wound C cores, as is shown in FIG. 2B.

As compared with a conventional in-line color cathode ray tube system with a self-convergent deflection unit dating back to the early 70s in which a 4-pole winding was arranged on the yoke ring, and apart from the fact that the invention uses a deflection unit which is not self-convergent, a difference is that the 4-pole according to the invention is completely positioned in front of the deflection unit and does not coincide with the deflection centre of the deflection unit, as was the case in the said cathode ray tube system.

As compared with a color cathode ray tube system having a deflection unit which is not self-convergent, in which local dipole fields around each of the two outer beams are used for convergence correction, a difference is that these dipole fields ensure that the field gradient between the beams is varied in a step-wise manner, with the above-mentioned drawback of a less satisfactory focusing possibility.

The embodiment shown in FIGS. 1 and 2 comprises a deflection unit having a 4-pole in front of the deflection unit, in combination with a "DAF" gun in the tube. A circuit for driving the 4-pole may be arranged on the coil. Another characteristic is that no poleshoes are used in the tube for correcting the side beams by means of local dipole fields. This also has the drawback that eddy currents occur if high line frequencies are used.

The use of the color cathode ray tube system is particularly suitable in high-resolution monitors and in future HDTV apparatus. The invention provides advantages, notably in cathode ray tubes having a display window with an aspect ratio of more than 4:3, for example, 16:9.

Figure 3:
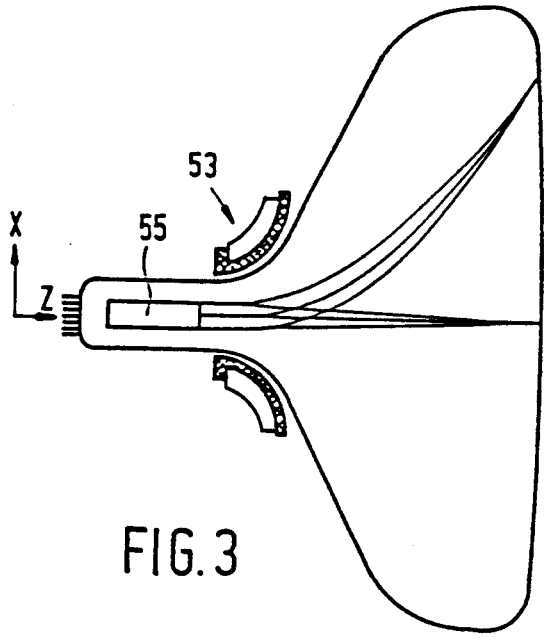
FIGS. 3, 4 and 5 are diagrammatic cross-sections of color cathode ray tube systems illustrating some aspects of the invention.
Figure 4:
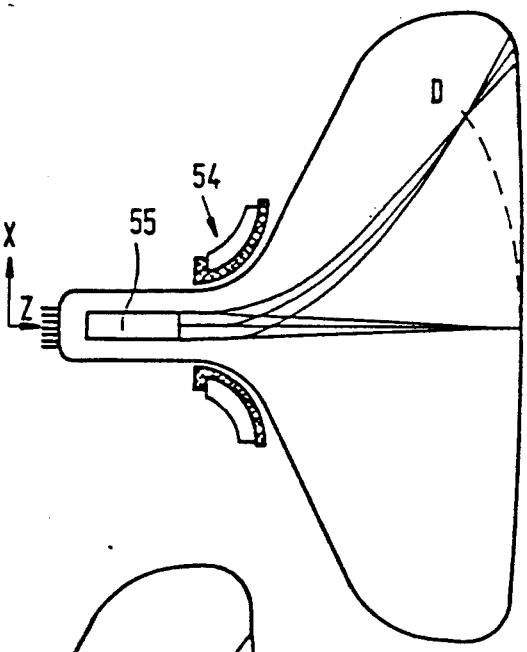
Figure 5:
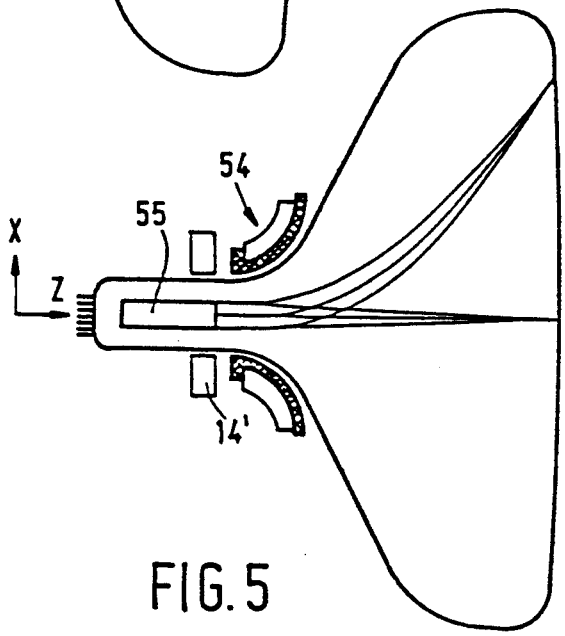

The recognition on which the invention is based will be further described with reference to FIGS. 3 to 5 showing diagrammatic cross-sections of color cathode ray tubes. FIG. 3 shows a state of the art color cathode ray tube with an electron gun 55 and a deflection system 53. The electron beams converge throughout the display window.

As compared with FIG. 3, the deflection system 53 in FIG. 4 is changed to the deflection system 54 which generates magnetic fields having a less pronounced astiqmat:c character. In the case of deflection overconvergence occurs and the electron beams intersect each other in front of the display window in plane D. The two effects, underconvergence and overconvergence, have of themselves a negative effect on the image and are therefore usually avoided and/or minimized to a maximum possible extent.

FIG. 5 shows the principle of a color cathode ray tube system according to the invention with electron gun 55 and deflection system 54. The underconvergence induced by an element 14, which moves the outer beams away from each other and which is arranged in front of the deflection unit 54, and the overconvergence induced by the deflection system 54 compensate each other in such a way that the color cathode ray tube system is self-convergent. If used in combination, both measures thus do not influence the convergence of the electron beams. The advantage of the invention is that the horizontal spot enlargement factor upon deflection is reduced, because at least the line deflection field has a less pronounced astigmatic character.

The effect of the invention is greater as the underconvergence induced by the element influencing convergence is greater. The maximum spot enlargement factor, i.e. the ratio between the spot diameter at the edges of the display window and the spot diameter in the centre of the display window, is approximately 2.2 in the known 110° color cathode ray tube. For the color cathode ray tube according to the invention this factor is preferably reduced to at least 2.0.

A further advantage of the less pronounced astigmatic character of at least the line deflection field is that the spot shape becomes more circular. In the known state of the art, the horizontal dimension of the spot at the edges of the display screen is considerably larger than the vertical dimension. A more uniform spot shape is desired, particularly for data displays. A too small vertical dimension may also result in Moire effects.

Figure 6:
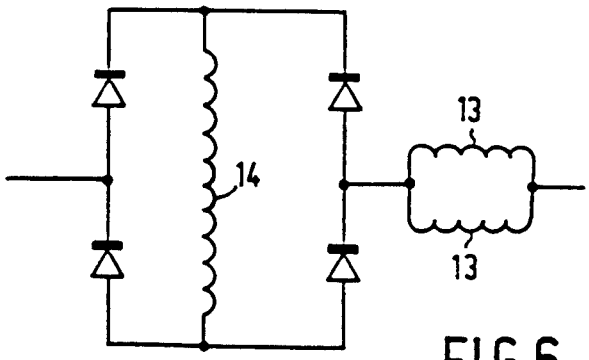
FIG. 6 shows an example of connecting the element 14 in a circuit.

FIG. 6 shows by way of example how the element 14 causing underconvergence can be incorporated in a circuit with the line deflection coils 13.

Figure 2A:
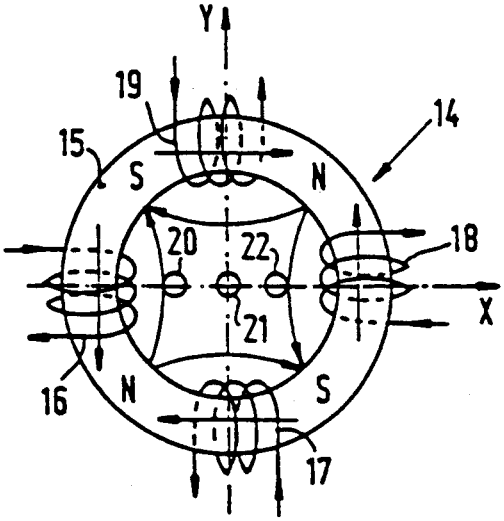
FIG. 2A is an elevational view of the element 14 causing underconvergence of the color cathode ray tube system of FIG. 1
Figure 2B:
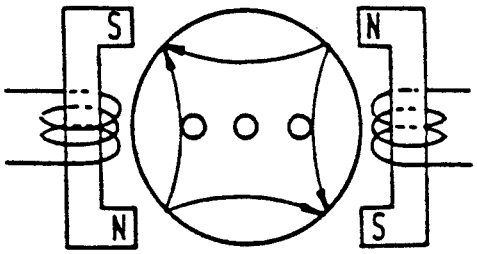
FIG. 2B is a cross-section through an alternative element causing underconvergence.
Figure 7:
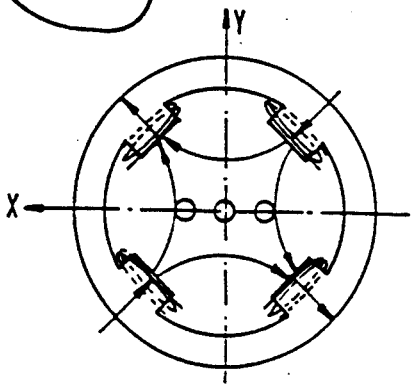
FIG. 7 shows an alternative embodiment of a 45° magnetic 4-pole element.

FIG. 7 shows a so-called stator construction with which a 45° magnetic 4-pole field can be generated, as an alternative to the constructions of FIGS. 2A and 2B.

The principle of an electron gun with D(ynamic) A(stigmatic) F(ocus) will be explained in more detail with reference to FIG. 8.

Figure 8:
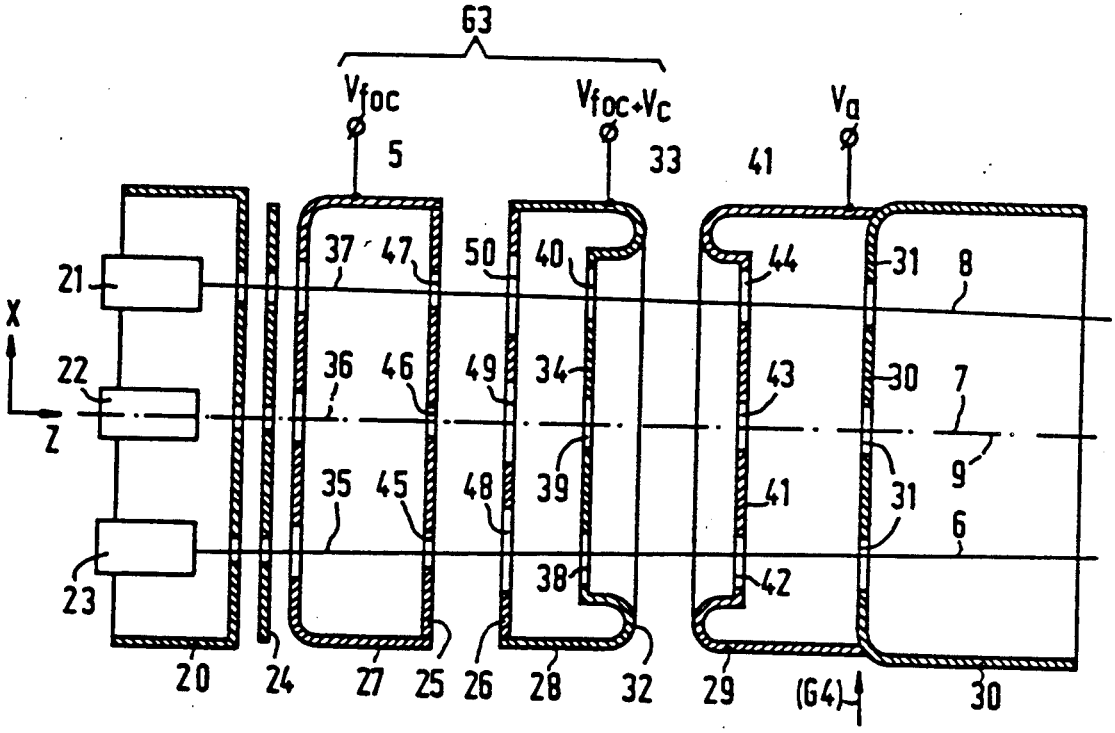
FIG. 8 is a longitudinal section of an electron gun suitable for color cathode ray tube systems according to the invention.

For the purpose of illustration, FIG. 8 is a longitudinal section of an electron gun suitable for use in a color cathode ray tube system according to the invention. This electron gun comprises a common cup-shaped electrode 20 in which three cathodes 21, 22 and 23 are secured and a common plate-shaped screen grid 24. The three co-planar electron beams are focused by means of the electrode systems (G3) and (G4) which are common for the three electron beams. Electrode system G3 comprises two cup-shaped parts 27 and 28 whose ends face each other. A main lens is constituted by applying suitable voltages to the first electrode system G3 and the second electrode system, or anode G4.

Electrode system G4 has one cup-shaped part 29 adjoining G3 and a centring bush 30 whose bottom has apertures 31 through which the electron beams pass. Electrode part 28 has an outer edge 32 extending towards electrode part 29 and electrode part 29 has an outer edge 33 extending towards electrode part 28. A recessed portion 34, which extends transversely to the plane through the axes 35, 36 and 37 of the electron beams 6, 7 and 8, has apertures 38, 39 and 40. A recessed portion 41, which extends parallel to recessed portion 34, has apertures 42, 43 and 44. The recessed portions 34 and 41 form one assembly with the electrode parts 28 and 29, respectively. For obtaining desired focusing fields, the apertures in the recessed portions may be, for example, circular or provided with collars, or they may be polygonal and without collars. In the latter case a polygonal gun is concerned.

In this embodiment an astigmatic element is formed in electrode system 63 by providing the open ends of the parts 27 and 28 with auxiliary electrodes 25, 26 in the form of flat plates having elongate (vertical) apertures 45, 46, 47 and elongate (horizontal) apertures 48, 49, 50, respectively. The apertures may have any shape leading to the formation of a 4-pole field for the electron beams passing through the apertures, for example, a rectangular, an oval or a diamond shape.

In operation, electrode 27 can be coupled to means, which are not shown in this FIG. for applying a constant focusing voltage $V_{foc}$. In this embodiment electrode 28 can be coupled to means for applying a control voltage $V_{foc}+V_C$.

Figure 9:
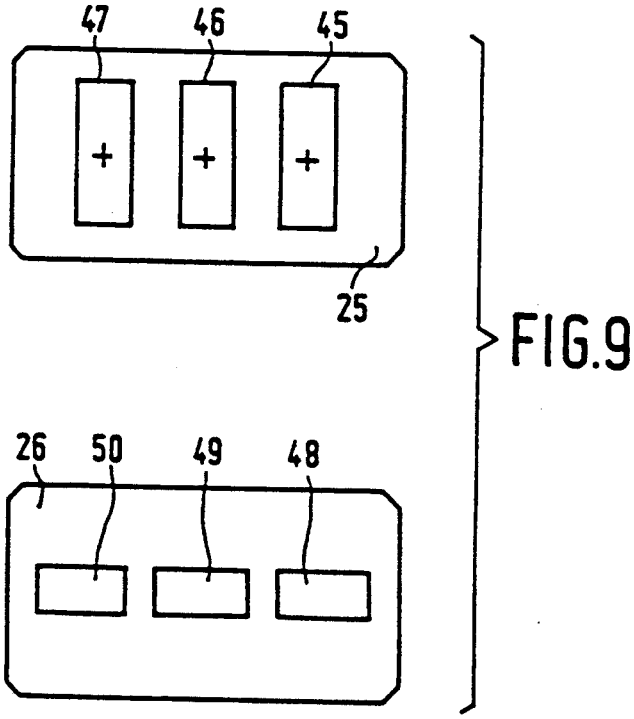
FIG. 9 is a front elevation of two auxiliary electrodes from the electron gun of FIG. 8.

FIG. 9 shows the auxiliary electrodes 25 and 26 of the electrode system of FIG. 8 in a front elevation. The axes of the electron beams 6, 7 and 8 are shown in this FIG. by means of crosses and substantially coincide with the centres of gravity of the (vertical) apertures 45, 46 and 47. The centres of the 4-poles formed in the apertures substantially coincide with the beam axes. The auxiliary electrodes may alternatively comprise two parallel electrode plates, one of which has three substantially vertical apertures and the other has one substantially horizontal, elongate aperture.

The embodiment shown should not be considered as limitative. For example, only one auxiliary electrode, controlled at $V_{foc}$, may be arranged between the electrode parts 27 and 28, with a control voltage $V_{foc}+V_C$ being applied to the two electrodes 27 and 28. More generally, any type of electron gun having a static or dynamic astigmatic focus can be used within the scope of the invention.

The invention is neither limited to the use of one 4-pole only (which influences the beams in the x direction).

Figure 10:
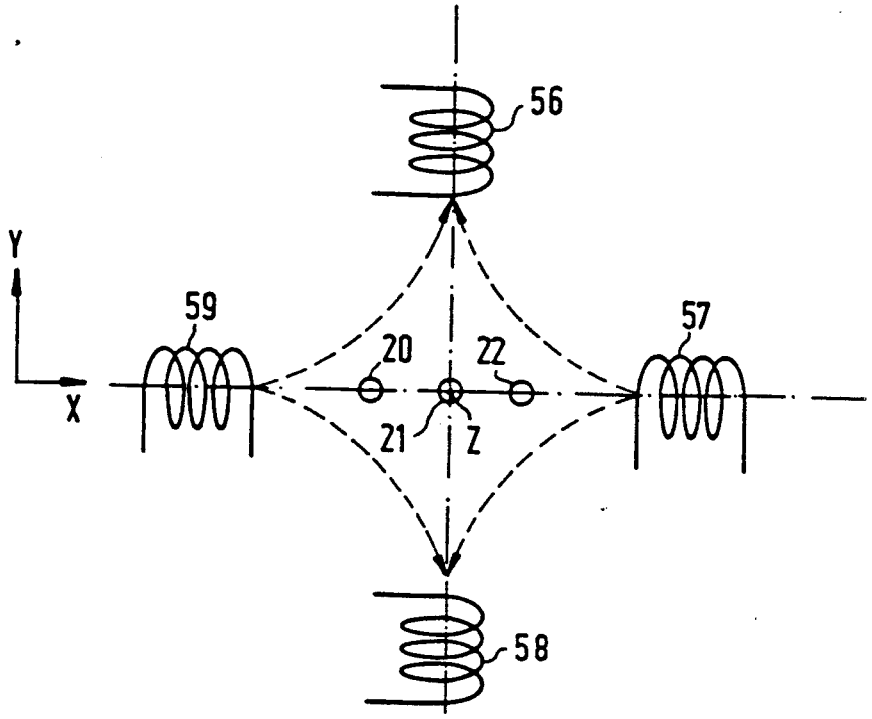
FIG. 10 shows diagrammatically an arrangement of four coils 56, 57, 58, 59 which, when energized, generate a 90° magnetic 4-pole field.
Figure 11:
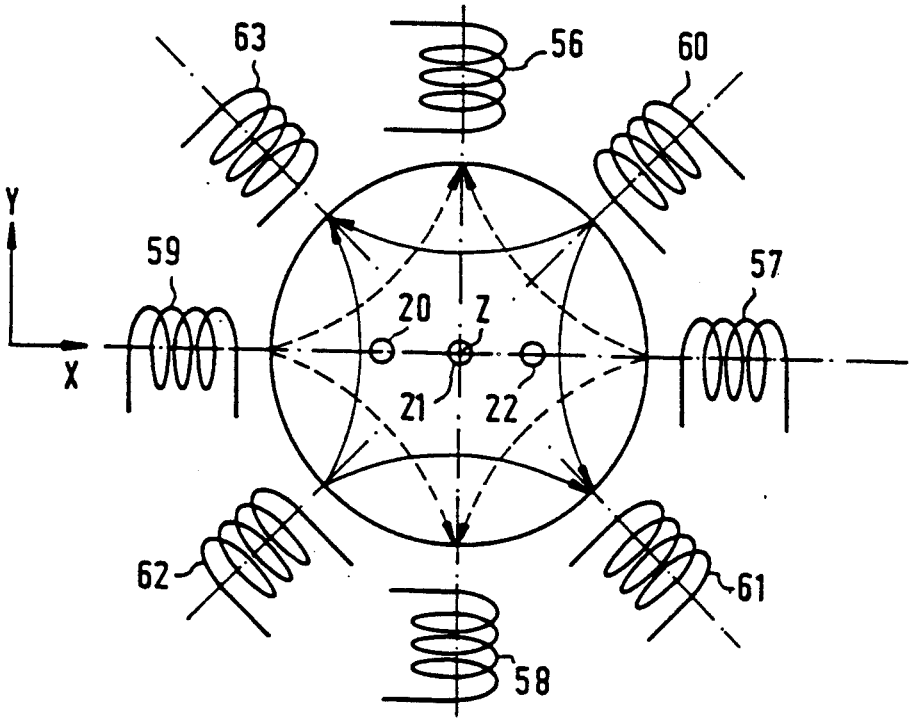
FIG. 11 shows diagrammatically an arrangement of four coils 56, 57, 58, 59 which, when energized, generate a 90° magnetic 4-pole field, together with an arrangement of four coils 60, 61, 62 and 63 which, when energized, generate a 45° magnetic 4-pole field.

To reduce the horizontal spot growth, an alternative way of achieving convergence is the use of two dynamically controlled magnetic 4-poles which are arranged around the beams (see FIG. 11). To generate these 4-poles, coil arrangements 56, 57, 58, 59 (FIG. 10) and 60, 61, 62, 63 can be used at different axial positions or at the same axial position {FIG. 11). The system described hereinbefore is based on a 4-pole which can only handle convergence in the x direction. The other convergence errors are then corrected by means of the coil. However, such a system requires north-south raster correction. In the relevant embodiment the y convergence errors are also corrected with an extra y-4-pole. The field forms of these 4-poles are shown in FIG.

11. It is then possible to design a coil which does not require any north-south raster correction.

The advantage of this concept resides in the design of the electronic circuit. The system of FIG. 1 requires dynamic signals for the x-4-pole and the north-south raster correction. In contrast to the raster correction, the 4-pole can be controlled with small electric signals. The system proposed as an alternative requires two 4-pole controls. Both of them are controlled by means of small electric signals.

We claim:

1. A color cathode ray tube system comprising (a) an evacuated envelope having a neck, a cone and a display window, (b) an electron gun in the neck, which gun has a beam-forming part for generating a central electron beam and two outer electron beams whose axes are co-planar, and a first and a second electrode system which in operation jointly constitute a main lens and are connectable to means for supplying an energizing voltage, (c) an astigmatic element in the electron gun for astigmatically influencing the electron beams, and (d) a deflection unit for generating line and field deflection fields for deflecting the electron beams, characterized in that an element causing underconvergence is arranged between the beam-forming part of the electron gun and the deflection unit, which element exerts a force on each outer electron beam having a component in the plane of the electron beams transversely to the axis of the relevant outer electron beam and remote from the central electron beam, said force deflecting the outer electron beams away from the central electron beam to cause said underconvergence, and in that the deflection unit is constructed in such a way that it generates deflection fields causing an overconvergence which compensates said underconvergence.

2. A color cathode ray tube system as claimed in claim 1, characterized in that the element influencing convergence comprises means which are coaxial with the tube axis and are adapted to generate a 45° magnetic 4-pole field.

3. A color cathode ray tube system as claimed in claim 1 or 2, characterized in that the color cathode ray tube has means for dynamically coupling the strength of the element causing underconvergence to the strength of the line deflection field.

4. A color cathode ray tube system as claimed in claim 3, characterized in that the means for dynamically coupling the strength of the element causing underconvergence to the strength of the deflection fields comprise means for applying a dynamically varying control voltage having a component which varies synchronously with at least the line deflection field.

5. A color cathode ray tube system as claimed in claim 4, characterized in that the component is parabolic.

6. A color cathode ray tube system as claimed in claim 1 or 2, characterized in that means which are coaxial with the tube axis are arranged between the beam-forming part of the gun and the deflection unit, which means are adapted to generate a 90° magnetic 4-pole field.

7. A color cathode ray tube system as claimed in claim 6, characterized in that the color cathode ray tube has means for dynamically controlling the means which are coaxial with the tube axis with a current which is derived from the field deflection current.

8. A color cathode ray tube system as claimed in claim 6, characterized in that the means which are coaxial with the tube axis are arranged in the same axial position as the element causing underconvergence.

9. A color cathode ray tube system as claimed in claim 1 or 2, in which the maximum deflection angle for the electrons is 55°, characterized in that the maximum horizontal spot enlargement factor is less than 2.0.

* * * * *